US009572436B2

(12) United States Patent
Jafa et al.

(10) Patent No.: US 9,572,436 B2
(45) Date of Patent: Feb. 21, 2017

(54) COOLER MERCHANDISER WITH CUSTOMIZABLE GRAPHICS

(75) Inventors: Emad Jafa, Valhalla, NY (US); Michel Saba, Valhalla, NY (US)

(73) Assignee: PepsiCo, Inc., Purchase, NY (US)

( * ) Notice: Subject to any disclaimer, the term of this patent is extended or adjusted under 35 U.S.C. 154(b) by 1136 days.

(21) Appl. No.: 12/177,791

(22) Filed: Jul. 22, 2008

(65) Prior Publication Data

US 2010/0018233 A1 Jan. 28, 2010

(51) Int. Cl.
*A47F 3/06* (2006.01)
*A47F 3/04* (2006.01)

(52) U.S. Cl.
CPC ..... *A47F 3/0482* (2013.01); *Y10T 29/53* (2015.01)

(58) Field of Classification Search
CPC ..... A47F 3/0426; A47F 3/043; A47F 3/0482; A47F 3/06; A47F 3/0404; G09F 2023/0033; G09F 7/10; G09F 7/08; G07F 17/0071
USPC ..... 62/249; 40/124.05, 606.04, 611.06
See application file for complete search history.

(56) References Cited

U.S. PATENT DOCUMENTS 2,297,574 A * 9/1942 McCord ..... G09F 1/12 40/606.19
4,274,267 A 6/1981 James et al.
4,537,040 A * 8/1985 Ibrahim ..... 62/186
4,919,287 A * 4/1990 Haskett ..... G09F 7/18 206/555
4,941,327 A * 7/1990 Miles ..... 62/246
5,366,284 A 11/1994 Baker
5,374,116 A * 12/1994 Borgen et al. ..... 312/116
5,386,766 A 2/1995 Segredo
5,418,055 A 5/1995 Chen et al.
5,509,225 A * 4/1996 Minh ..... G07F 9/02 40/575

(Continued)

FOREIGN PATENT DOCUMENTS

DE 3513201 A1 10/1986
DE 29804825 U1 6/1998

(Continued)

OTHER PUBLICATIONS

Decision on Grant in corresponding RU Application No. 2009127616/21(038406) mailed Oct. 21, 2010.

(Continued)

*Primary Examiner* — Cassey D Bauer
(74) *Attorney, Agent, or Firm* — Sterne, Kessler, Goldstein & Fox P.L.L.C.

(57) ABSTRACT

A display unit may be a cooler merchandiser for displaying products, such as food and beverages. The cooler merchandiser may have a housing that contains a display portion for displaying one or more products and a cooling portion that may be configured to cool the products in the display portion. A frame may be attached to the housing and may extend along at least a portion of the perimeter of a surface of the housing. A removable insert may slide into the frame so that it is positioned adjacent to a surface of the housing. The removable insert may include a cardboard material and the housing may include a rigid styrene material. The removable insert may display a graphics that may be customized. An opening may be provided in the housing to provide access to the display portion and a thermo-protective barrier may be provided to cover the opening.

26 Claims, 6 Drawing Sheets

(56) References Cited

U.S. PATENT DOCUMENTS

| | | | | |
|---|---|---|---|---|
| 5,516,204 | A | 5/1996 | Calvert | |
| 5,706,976 | A * | 1/1998 | Purkey | G07F 9/02 221/6 |
| 5,791,497 | A | 8/1998 | Campbell | |
| 5,803,560 | A * | 9/1998 | Trulaske et al. | 312/223.5 |
| 6,021,908 | A | 2/2000 | Mathews | |
| 6,023,870 | A | 2/2000 | McGarrah | |
| 6,230,426 | B1 * | 5/2001 | Fakhoury | G07F 9/02 24/542 |
| 6,415,623 | B1 * | 7/2002 | Jennings et al. | 62/457.2 |
| 6,431,395 | B1 | 8/2002 | San Martin | |
| 6,843,382 | B2 | 1/2005 | Kanouchi et al. | |
| 7,204,570 | B2 * | 4/2007 | Benitsch et al. | 312/408 |
| 7,325,346 | B2 * | 2/2008 | Chirnomas et al. | 40/611.06 |
| 2002/0088244 | A1 | 7/2002 | Jennings | |
| 2003/0136750 | A1 * | 7/2003 | Fujii | A47F 5/0093 211/90.02 |
| 2004/0111938 | A1 * | 6/2004 | Ozawa | 40/591 |
| 2006/0138910 | A1 * | 6/2006 | Dresser | 312/116 |
| 2008/0148753 | A1 * | 6/2008 | Welker et al. | 62/255 |

FOREIGN PATENT DOCUMENTS

| | | |
|---|---|---|
| EP | 0943272 | 9/1999 |
| GB | 411963 | 6/1934 |
| JP | 9182512 | 7/1997 |
| RU | 2214781 C1 | 10/2003 |
| WO | 03015040 A | 2/2000 |
| WO | 00/27226 | 5/2000 |

OTHER PUBLICATIONS

Extended European Search Report in corresponding EP Application No. 09008976.4-2313 mailed Oct. 30, 2009.

Office Action from Canadian application No. 2,671,285, mailed Sep. 13, 2011.

Russian Office Action from application RU 2010150164, mailed Dec. 7, 2011.

Mexican Office Action from Mexican Application No. MX/A/2009/007757; dated Feb. 26, 2013.

Canadian Office Action from application CA 2,671,285, mailed Jul. 26, 2012.

Jha, Non-destructive Determination of Acid-brix Ratio of Tomato Juice Using Near Infrared Spectroscopy, International Journal of food Science and technology, vol. 39, 2004, pp. 425-430, IXP002507334 abstract.

XP002507335, Database WPI Week 199738, Thomson Scientific, London, GB, AN 1997-409817.

European Communication from application No. 09 008976.4 mailed Mar. 16, 2010.

CN Application No. 200910159765.9 Office Action mailed Nov. 16, 2010.

European Communication from application No. 09 008976.4, mailed Nov. 5, 2012.

Mexico Office Action from application MX/a/2009/007757, mailed Jul. 11, 2012.

Aug. 30, 2013 (CA) Office Action—App 2671285.

* cited by examiner

COOLER MERCHANDISER WITH CUSTOMIZABLE GRAPHICS

FIELD OF THE INVENTION

Aspects of the invention relate generally to cooler merchandisers for storing and displaying items, such as food and beverage products. More specifically, the invention relates to cooler merchandisers having customized graphics.

BACKGROUND

Oftentimes, perishable food and beverage items require a controlled storage environment. Consequently, many storage units have been developed that contain a mechanism that controls the environment of an enclosed space, such as a refrigerator. Most of these units have some kind of access portal, like a door, or slidable window that provides access to the enclosed, interior space of the storage unit for retrieving products (such as food and beverage products) from the cooling unit. However, these storage units are often made of a heavy material, such as metal, and may be difficult to move and repair. Most of the units are not portable due to their weight and size. Further, the exterior surface of the display units is not easily repaired or changed and the appearance of the unit is not easily updated or remodeled.

Portable cooler merchandiser units have been developed that reduce the weight of the cooling units and create an environment in which the environment of the interior space can be controlled. A manufacturer and/or merchant may wish to sell food and beverage products at a store. A cooler capable of storing the food and beverage products may be positioned at the point of sale to attract consumers.

For example, a manufacturer might want to sell perishable food products at a store, such as a grocery store, a convenience store, or any other typical point of sale. This type of sale often targets consumers by displaying advertising, logos, or any other appealing presentation on the products or on the cooler merchandiser that stores and displays the products. Advertising has become crucial for selling products and reaching consumers, such as the food and beverage products that are described above. Most products are associated with a manufacturer or company by a logo or other graphics associated with the container, product, or service during the sales process. Many sellers choose to directly apply a graphics or logo to the product itself or to the container from which the product is sold.

Some of the cooling units described above may be imprinted with the graphics, logos, or other advertising indicia to attract consumers to the products at a point of sale. The graphics, logos, and other advertising indicia are typically affixed in a permanent fashion to the cooling unit. In many configurations, the graphics, logos, and other advertising is permanently applied to the housing structure of the cooling unit and may only be replaced by replacing the entire or a large portion of the housing. Most advertising strategies frequently change and replacing the housing to reflect the current advertising is inefficient, burdensome, and expensive.

Although many cooler merchandisers exist in the art, there is room for improvement. A cooler merchandiser that is lightweight and easily transportable would be a welcomed advancement in the art. Additionally, a cooler merchandiser having a housing displaying a graphics that may be inexpensively and efficiently changed would also be a welcomed advancement in the art.

SUMMARY

The following presents a general summary of aspects of the invention in order to provide a basic understanding of at least some of its aspects. This summary is not an extensive overview of the invention. It is not intended to identify key or critical elements of the invention and/or to delineate the scope of the invention. The following summary merely presents some concepts of the invention in a general form as a prelude to the more detailed description provided below.

In an aspect of the invention, a cooler merchandiser may comprise: (1) a housing having a display portion for displaying a product and a cooling portion configured to cool the product displayed in the display portion; (2) a frame attached to the housing, the frame extending along at least a portion of the perimeter of a wall of the housing; and (3) a first removable insert having a first graphics that may be capable of fitting within the frame. The insert may be capable of slidingly engaging with the frame, i.e., by sliding into a channel defined by the frame and a surface of the housing.

In another aspect of the invention, a cooler merchandiser may comprise: (1) a housing defining an interior space for housing at least one product; (2) a frame attached to an exterior surface of the housing; and (3) at least one removable cardboard insert capable of slidingly engaging with the frame. The housing may have a top wall, a bottom wall, and a plurality of side walls. The frame may be attached to one or more of the top wall, the bottom wall, and any portion or all of the side walls. The removable cardboard insert may be customized. The removable cardboard insert may also be positioned adjacent to the housing when it is positioned within the frame (i.e., the cardboard insert may be positioned adjacent to one or more of the top wall, the bottom wall, and any portion or all of the side walls). The top wall, the bottom wall, and the plurality of side walls define an interior space for containing and cooling at least one product.

In yet another aspect of the invention, a cooler merchandiser may be customized by the steps comprising: (1) applying a first graphics to a first removable insert and a second graphics to a second removable insert; (2) inserting the first removable insert into a frame attached to an exterior surface of a housing for cooling products; (3) removing the first removable insert from the frame; and (4) inserting the second removable insert into the frame.

BRIEF DESCRIPTION OF THE DRAWINGS

A more complete understanding of the present invention and certain advantages thereof may be acquired by referring to the following description along with the accompanying drawings, in which like reference numbers indicate like features, and wherein.

Figure 1:
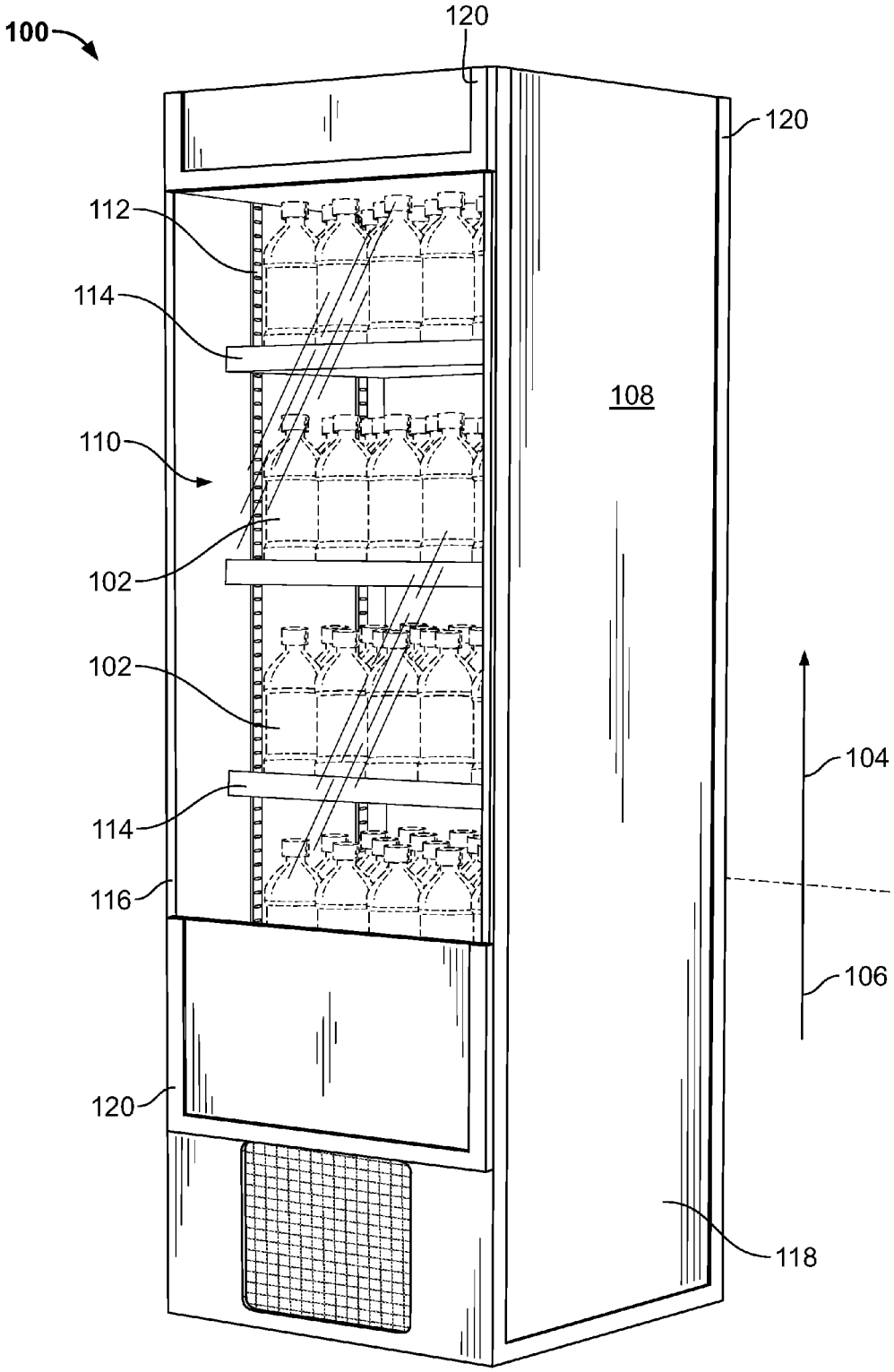
FIG. 1 illustrates a cooler merchandiser with a frame and removable inserts, according to aspects of the invention.

The reader is advised that the attached drawings are not necessarily drawn to scale.

DETAILED DESCRIPTION

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

A. General Description of the Cooler Merchandiser

In general, as described above, aspects of the invention relate to cooler merchandisers. In accordance with at least some aspects of the invention, a cooler merchandiser may comprise a housing; a frame attached to the housing; and a first removable insert capable of fitting within the frame. The housing may have a display portion for displaying a product and a cooling portion configured to cool the product displayed in the display portion. The frame may extend along at least a portion of the perimeter of a surface of the housing. The first removable insert may have a first exchangeable graphics. The first removable insert may be capable of slidingly engaging with the frame.

The cooler merchandiser may be any device having an enclosed space for storing products, such as food and beverage products. Any products may be placed within the enclosed space of the cooler merchandiser. The cooler merchandiser may be any suitable size and shape. For example, the cooler merchandiser may be very large and may enclose a large space, such as a typical room for a walk-in refrigerator or freezer. In another example, a cooler merchandiser may be relatively small, such as the cooler merchandiser that may be positioned in a store or at another point of sale. The cooler merchandiser may be any suitable shape including, but not limited to a sphere, a cube or rectangular enclosure, or any other polygon shape. The cooler merchandiser may be any suitable three dimensional container.

The cooler merchandiser may have a housing that includes any suitable material. The housing may include styrene, foam, metal (i.e., galvanized steel), wood, plastics, composite material, glass, and the like. The material of the housing may be synthetic and/or non-synthetic material. For example, the housing may be made of a styrene material, as conventionally available in the art. The styrene material may be rigid. The housing may be made of a single type of material or may be created by combining and/or attaching a plurality of types of materials. One or more pieces may define the housing. The one or more pieces may be of a unitary construction or may be individually formed. Each of the pieces may be any suitable shape and size. For a housing with a plurality of pieces, each of the pieces may be the same shape and/or size or one or more of the pieces may be of a different shape and/or size.

The housing may define an interior space for housing one or more products. The interior space may have a top wall, a bottom wall, and a plurality of side walls. The top wall, the bottom wall, and the plurality of side walls may form a shape such as a cube, a cuboid, or any other three-dimensional shape. The top wall, the bottom wall, and the plurality of side walls may be attached together at any angle, such as a right angle, an acute angle, an obtuse angle, or any combination thereof. The top wall, the bottom wall, and the side walls may be flat or may have a curved surface. Each of the top wall, the bottom wall, and the side walls may be any suitable size and shape.

The housing may be capable of displaying products. For example, the housing may have shelves or a display area for positioning products, such as food and beverage products. The display area may have any number of shelves. The shelves may contain any suitable material, including, but not limited to, plastics, wood, metals, and the like. The shelves may include wire that form one or more slits in the shelf and define a surface upon which products may be displayed. The shelves may be adjustable within the display area. The shelves may also be extendable from the housing, such as being extendable through the opening defined in the housing to provide a user with easy access to the products situated in the rear portion of the shelf that may otherwise be difficult to reach.

The display area may be a portion of the interior space defined by the housing. A portion of the display portion may or may not be visible from the exterior of the cooler merchandiser. An opening may provide access to the display portion to retrieve the products, as described in greater detail below. The display portion may include advertisements, shapes, colors, logos, props, or other features that may encourage a consumer to view and/or retrieve a product from the display portion of the housing.

The housing may also have a cooling portion that is configured to maintain a suitable environment within the display portion (interior space) of the housing. The cooling portion may be configured to maintain a suitable temperature for storing and/or displaying the products within the display portion of the housing. The cooling portion may also be configured to maintain additional environmental characteristics of the display area, such as humidity, ventilation, air pressure, and any other environmental characteristic of the display portion. The cooling portion may be electrical and/or mechanical and may be fixedly or selectively attached to the display portion of the housing. For example, the cooling portion may include positioning ice or another cooling device within the display portion to cool the interior space and keep the products that are stored within the display portion cool, such as in a conventional insulated box (i.e., a "cooler"). The cooling portion may also be a conventional electro-mechanical device that is configured to maintain a suitable temperature and humidity within the display portion.

The housing may contain insulation. The insulation may be any suitable material or element that is capable of preventing heat transfer between the interior space defined by the walls of the housing and the exterior space outside of the housing. For example, one or more walls of the housing may contain an insulating insert that may be inserted within the wall to help maintain a cool temperature within the housing.

The cooler merchandiser may have a frame. The frame may be attached to the housing in any suitable manner. The frame may extend along any suitable portion of the housing. For example, the frame may extend along a portion of the perimeter of a wall of the housing. The housing may define a space such as a cube, a rectangular cuboid, or any other shape. One or more of the walls of the housing may have a frame that extends along the perimeter of the wall. In some examples, the frame may extend along two opposing edges of a wall of the housing. This configuration would provide support along opposing edges for the removable insert that may be slid into the frame. The frame may extend along a first edge of the housing and along a second edge of the housing, the first edge being positioned along an opposite edge of the wall. Further, this configuration would permit easy removal and replacement of the removable insert by sliding the removable insert in a direction that is parallel to the position of the frame.

In another example, the frame may extend along the entire perimeter of one or more walls (i.e., at or near the edges of the walls) of the housing. The frame may be detachable from the housing so that the removable insert may be replaced. The frame may also be fixedly attached to the housing. In this configuration, the removable insert may be capable of flexing so that the edges of the removable insert may slide into the frame from any desired angle.

In some example embodiments, the frame extends along the exterior surface of the housing. In other examples, the frame may be embedded within a wall of the housing. In yet another example, the housing and the frame may be formed from a unitary construction. For example, the housing and the frame may be formed from a single piece of material. The housing and the frame may also be formed from two or more pieces of material that may be permanently or selectively attached to each other. The frame may contain any suitable material, such as aluminum or another metal, plastics, and wood.

The frame may comprise a unitary construction or a plurality of separate pieces. For example, the frame may comprise a first element and a second element that are selectively attachable to each other. The first element and the second element may be attachable to each other by any suitable mechanical connector.

The frame may be any suitable shape and/or size and may be attached to the housing in any suitable manner, as described above. For example, the frame may form a channel for receiving a portion (e.g., an edge) of the removable insert. The channel may be a U-shape, a C-shape, or a J-shape. The edge of the removable insert may be shaped in a complimentary fashion to the U-shape, the C-shape, or the J-shape of the channel. For example, the edges of the removable insert may be rounded to fittingly slide into the U-shaped, C-shaped, or J-shaped frame, respectively. Any suitable shape of the frame and the edge of the removable insert may be implemented. Any suitable connector may secure the removable insert within the frame.

Each of the U-shaped, C-shaped, and J-shaped frames may have a first end and a second end. The first end of the frame may be attached to the housing in any suitable fashion (permanently or selectively attached together). The second end of the frame may extend away from the housing and may be free from the housing, thereby forming the U-shaped, the C-shaped, or the J-shaped channel between the frame and the housing.

The cooler merchandiser may also have one or more removable inserts. The removable insert may slidingly engaged to fit within the frame. For example, the edge of the removable insert may fit within a space defined by the frame, as described above. The frame may define a space shaped as a long narrow channel into which the edge of the removable insert may slide from one or more directions. Any suitable mechanical connector may secure the removable insert within the frame. Some examples of mechanical connectors that may be suitable for this use are: friction-creating materials (i.e., rubber), ridges or other formations on the surface of the edge of the removable insert that cause friction between surfaces, a protrusion positioned on the edge of the removable insert that may be fitted within the channel secure the two pieces together, adhesives, or any other suitable connectors. In some examples, no mechanical connector is used to connect the removable insert and the frame.

The removable insert may be any suitable shape and size. For example, the removable insert may be shaped in a similar shape to one of the walls of the housing. In some examples, a side wall of the housing may be a rectangular shape and the removable insert may be a similar rectangular shape. The removable insert may be fitted within the frame so that it is positioned adjacent to the side wall of the housing and so that it extends across substantially all of the side wall of the housing. The removable insert may extend across any portion of the housing.

In some examples, a rectangular housing may have a top wall, a bottom wall, and a plurality of side walls. A top wall removable insert may be slid into the frame extending along a portion of the top wall and a plurality of side wall removable inserts may be slid into the frame extending along a portion of one or more of the side walls. The cooler merchandiser may have any suitable wall or portion of a wall covered by a removable insert.

The removable insert may have a graphics. The graphics may include any illustration, graphics, logos, text, pictures, or the like. The graphics may also include any attachments or other objects that may be attached to the removable insert. Additionally, the graphics may correlate with a product and/or an advertisement. The graphics and/or the advertisement may be customized for a particular product or may be customized to target a particular group of consumers or possible users of the products. In some example cooler merchandisers, a first removable insert may have a first graphics and a second removable insert may have a second graphics that is different from the first graphics. The first graphics may be customized to correlate to a first advertisement and the second graphics may be customized to correlate to a second advertisement that is different from the first advertisement. The first advertisement and the second advertisement may both relate to the same product, yet each advertisement may be a different.

The removable insert may contain any suitable material, such as metal, wood, plastic, cardboard, paper, glass, or the like. In some examples, the removable insert is made substantially of cardboard material. The cardboard removable insert may have cost-efficient manufacturing and easy installation. The cardboard insert may be replaced for any suitable reason, such as wear, change in advertising strategy, change in consumer target group, or any other reason.

The cooler merchandiser may also have a protective layer that covers at least a portion of the removable insert. For example, the protective layer may be a transparent sheet of plastic or glass that slides into the frame in a similar fashion to the removable insert sliding into the frame. The protective layer may be positioned to face away from the housing, i.e., the removable insert would be sandwiched between the housing and the protective layer. In this configuration, the protective layer would provide a barrier that may cover at least a portion of the removable insert to prevent the removable insert from being exposed to the exterior surface of the cooler merchandiser. The protective layer may contain any suitable material or materials.

The cooler merchandiser may include a housing having an opening. The opening may provide access from the exterior of the cooler merchandiser into the display portion. For example, the opening may define a hole or other void within a portion of a wall of the housing. The opening may permit a consumer or other user to reach into the interior space of the housing to select a product in the display portion. The opening may provide access to any portion of the cooler merchandiser. The opening may be positioned in any portion of the housing. For example, the opening may be positioned within one or more side walls of the housing.

The cooler merchandiser may have more than one opening. In some example cooler merchandisers, a first opening may be positioned within a first side wall and a second opening may be positioned within a second side wall that is different from the first side wall. Some example cooler merchandisers may have an opening positioned in the top wall as well.

A thermo-protective barrier may extend across the opening. The thermo-protective barrier may include a glass door, a thermo-protective barrier (such as a sheet designed to retractably extend across the opening), a ventilation system designed to maintain a protective air barrier across the opening, or any other suitable thermo-protective barrier. The thermo-protective barrier may extend across any portion of an opening. For example, the thermo-protective barrier may be a curtain that extends across the opening. In another example, the thermo-protective barrier may be a plastic or glass door that extends across the opening. The door may be opened via a hinge configuration, a sliding door configuration, or any other suitable arrangement.

In another aspect, a cooler merchandiser may comprise a housing, a frame attached to the exterior surface of the housing, and at least one removable cardboard insert that may slidingly engage with the frame. The housing may define an interior space for housing at least one product. The housing may have a top wall, a bottom wall, and a plurality of side walls. The frame may be attached to at least one of the top wall, the bottom wall, and the plurality of side walls. The removable cardboard insert may have a customized graphics. The customized graphics may be any suitable graphics, features, objects, or the like. When the removable cardboard insert is slidingly engaged within the frame, the removable cardboard insert may be positioned adjacent to at least one of the top wall, the bottom wall, and at least one of the side walls.

In yet another aspect, a method of providing graphics on a cooler merchandiser may comprise steps of: (1) applying a first graphics to a first removable insert and a second graphics to a second removable insert; (2) inserting the first removable insert into a frame that may be attached to an exterior surface of a housing for cooling products; (3) removing the first removable insert from the frame; and (4) inserting the second removable insert into the frame. Any suitable number of removable inserts may be slid into the frame.

B. Specific Examples of the Cooler Merchandiser

FIG. 1 illustrates cooler merchandiser 100 for displaying products 102. The cooler merchandiser 100 has a display portion 104 and a cooling portion 106 attached to the bottom of the display portion 104. The display portion 104 may define an interior space 110 in which a plurality of shelves 114 may be situated. The shelves 114 may be capable of storing products 102 and the position of the shelves 114 within the interior space 110 may be adjustable by any mechanism, such as the bracket 112 shown in FIG. 1. The display portion 104 may be a three-dimensional rectangular shape. An opening 116 may comprise a substantial portion of one of the side walls 118 of the display portion 104, as illustrated in FIG. 1.

Figure 2:
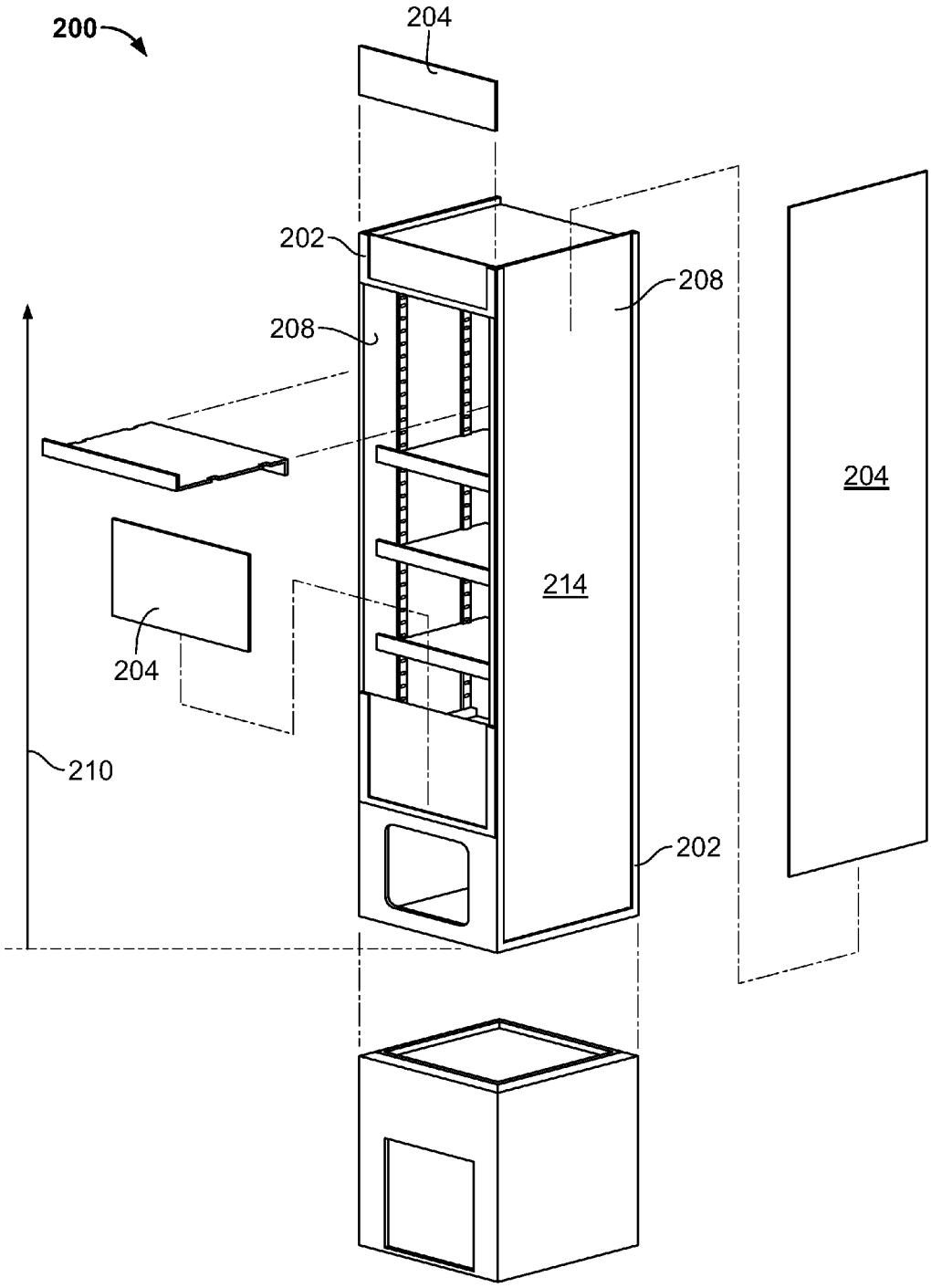
FIG. 2 illustrates an exploded view of the cooler merchandiser with the frame and the removable inserts of FIG. 1.

FIGS. 1 and 2 illustrate an example cooler merchandiser 100, 200 having a frame 120, 202 and removable inserts 204. For example, FIG. 2 shows a frame 120, 202 that is positioned along three edges of a side wall 120, 208 of the display portion 104, 210 of the housing 108, 214. As described in greater detail above, a frame may be positioned on any surface of the housing. The frame of FIG. 2 is shown to extend along opposing side walls and a portion of a front wall.

Figure 3:
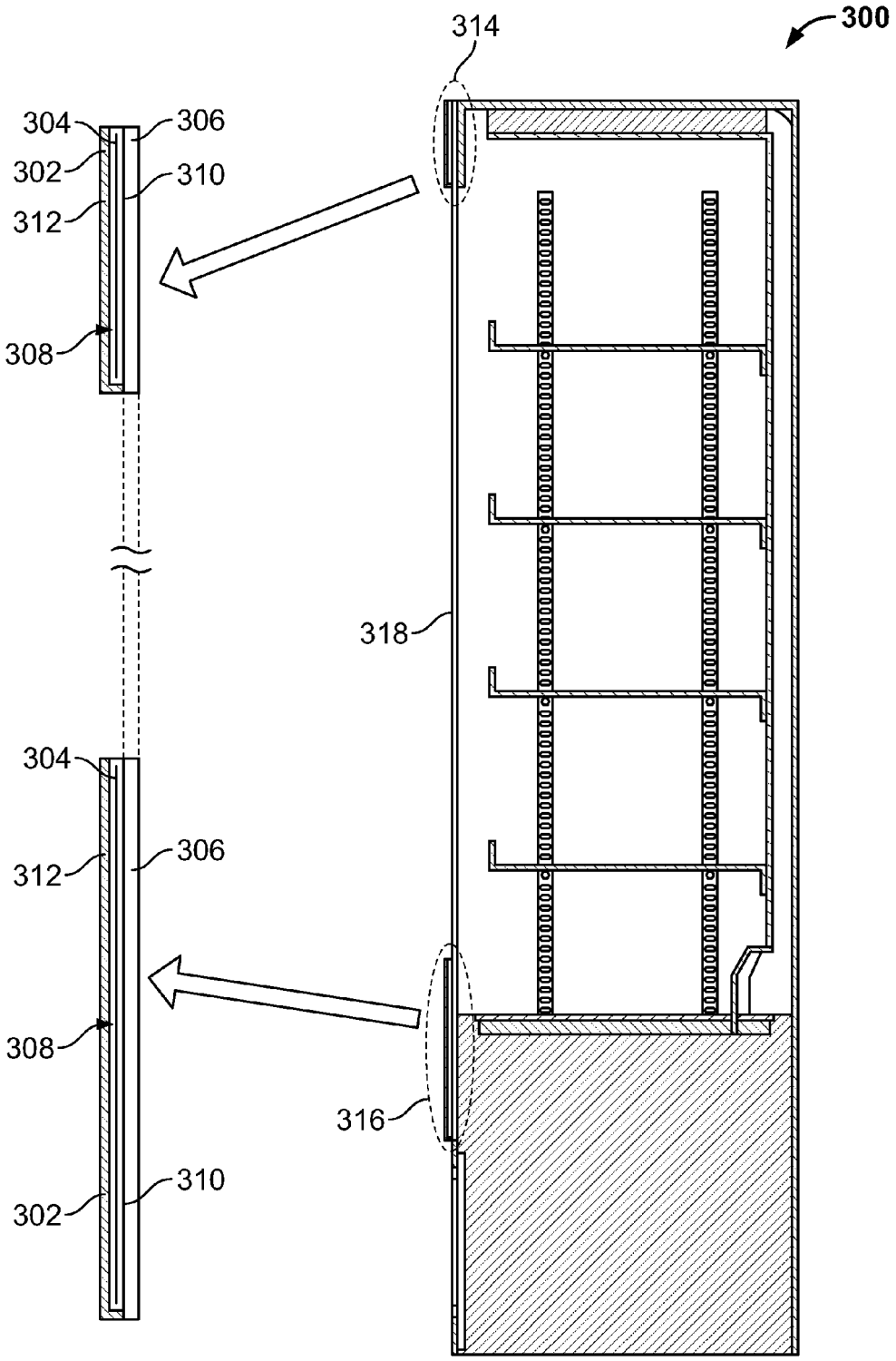
FIG. 3 illustrates a cross-sectional view of the cooler merchandiser with the frame and the removable inserts of FIG. 1.

FIG. 3 illustrates a cross-sectional view of a portion of the cooler merchandiser 300, frame 302, and removable inserts 304. The frame 302 and the side wall 306 form a U-shaped channel 308. A first end 310 may be attached to the side wall 306 of the housing and a second end 312 may extend away from the side wall 306 of the housing and may be free from the side wall 306 of the housing. The frame 302 and side wall 306 may form a channel 308 into which the removable insert 304 may be slid. The removable insert 304 is shaped to slidingly engage into the U-shaped channel 308. When the removable insert 304 is positioned within the U-shaped channel 308, the removable insert 304 is positioned between the side wall 306 and the frame 302. FIG. 3 illustrates a side wall 306 having a first frame combination 314 and a second frame combination 316 positioned on opposite ends of the opening 318.

Figure 4:
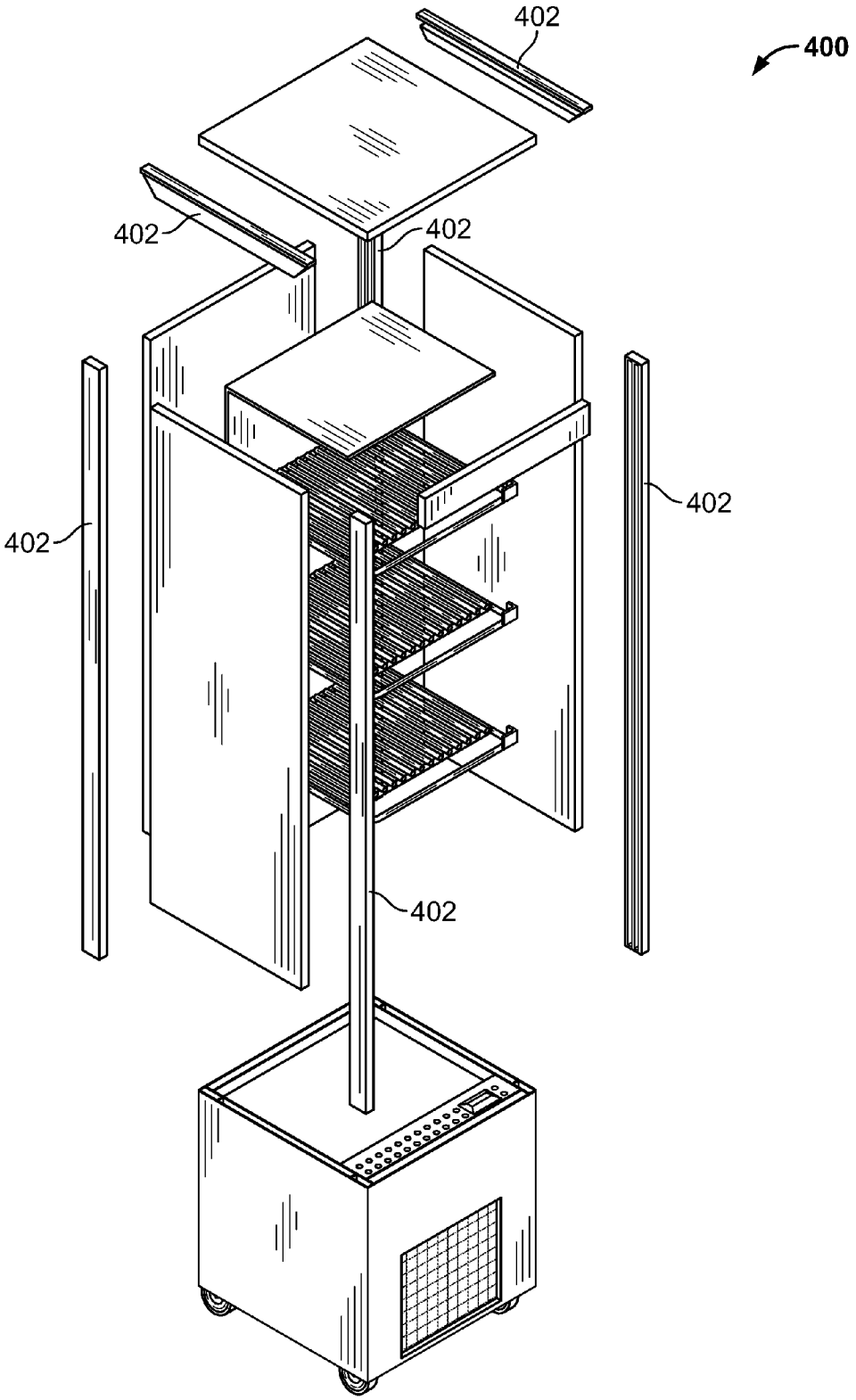
FIG. 4 illustrates an alternative embodiment of the cooler merchandiser, in accordance with aspects of the invention.

FIG. 4 illustrates an alternative embodiment of the cooler merchandiser 400. In this configuration, the frame may comprise a plurality of elements 402 that may each be selectively attachable to each other via a mechanical connector. In this example, the plurality of elements are selectively attachable at the intersection (or corners) of two elements. The plurality of elements may be detachable at any suitable position along the frame.

Figure 5A:
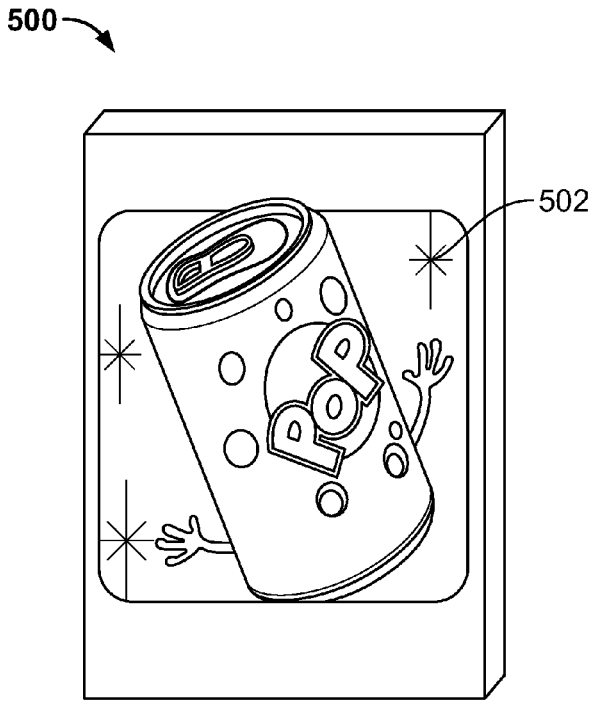
FIGS. 5A and 5B illustrate a first removable insert and a second removable insert, in accordance with aspects of the invention.
Figure 5B:
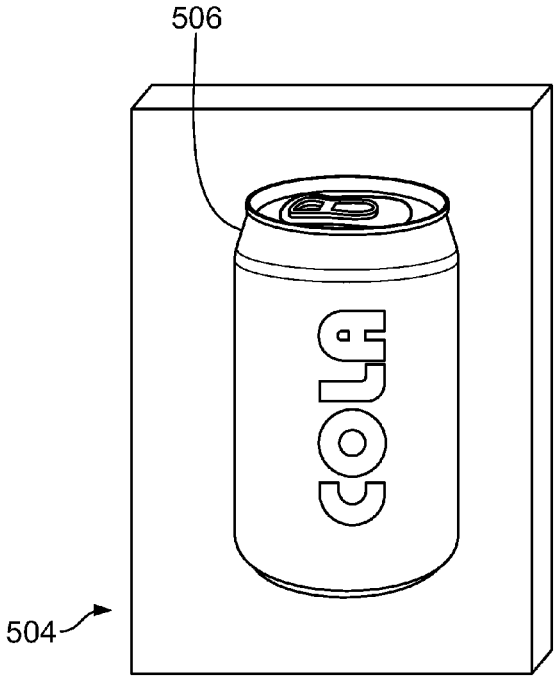

FIGS. 5A and 5B illustrate a first removable insert 500 having a first graphics 502 and a second removable insert 504 having a second graphics 506 that is different than the first graphics 502. The first graphics 502 may be related to a first advertisement and the second graphics 506 may be related to a second advertisement.

Figure 6:
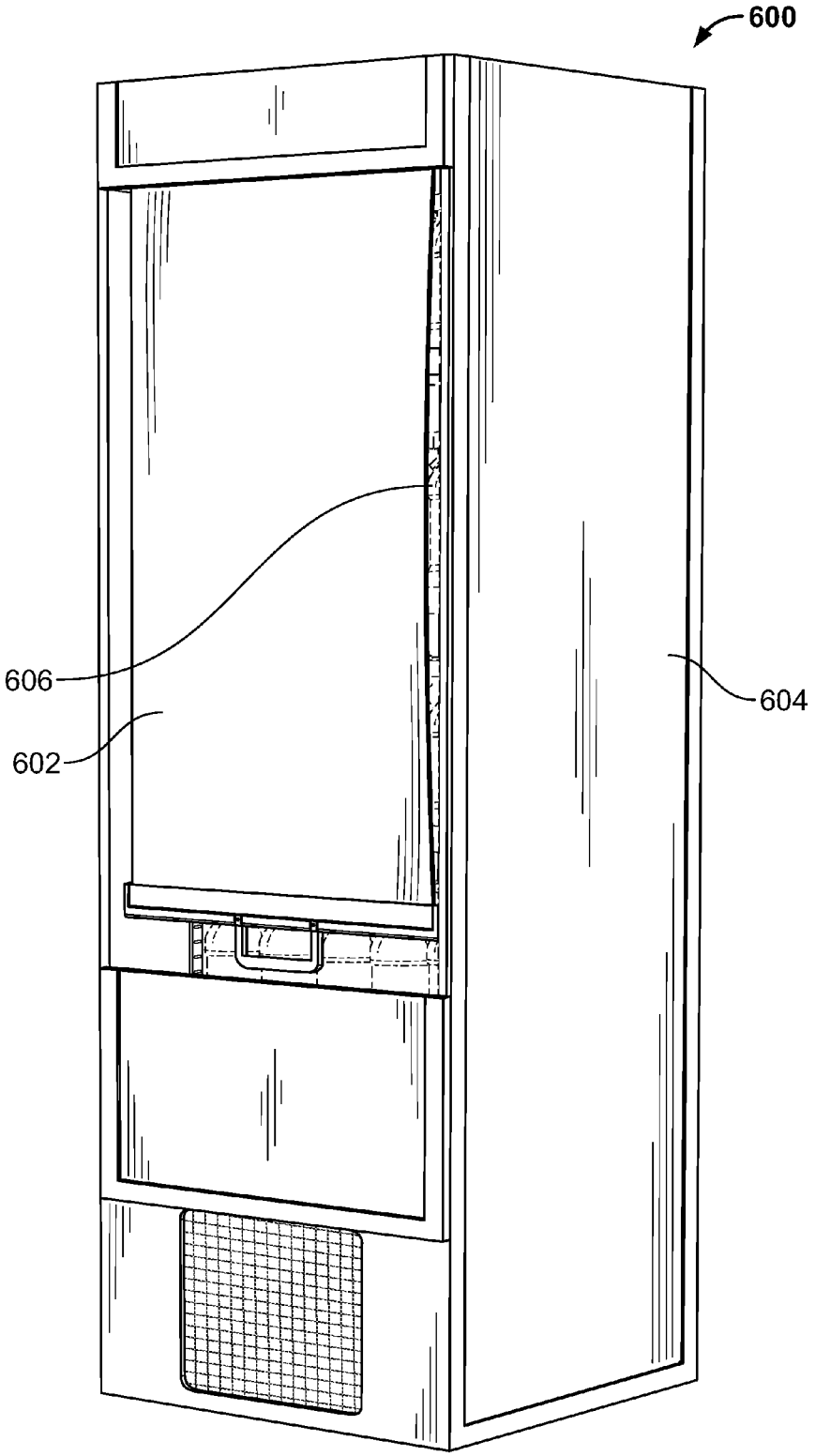
FIG. 6 illustrates a thermo-protective barrier for a cooler merchandiser, in accordance with aspects of the invention.

As explained in greater detail above, the opening in a cooler merchandiser may have a thermo-protective barrier. In the example cooler merchandiser 600 illustrated in FIG. 6, a retractable thermo-protective barrier 602 is capable of extending across the opening 606 of the housing 604 of the cooler merchandiser 600.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A cooler merchandiser, comprising:

a housing having a display portion for displaying a product and a cooling portion configured to cool the product displayed in the display portion, wherein at least a portion of the housing includes an opening for providing access to the display portion, wherein the housing further includes a plurality of shelves that are horizontally extendable through the opening;

a frame attached to the housing, the frame extending along at least a portion of the perimeter of a surface of the housing;

a first removable insert having a first graphics, the first removable insert configured to fit within the frame, the first removable insert further configured to slidingly engage with the frame, wherein the frame and a side wall of the cooler merchandiser together form a channel configured to allow the first removable insert to slidingly engage the channel, wherein the first removable insert is positioned between the frame and the side wall, and wherein the first removable insert is secured within the frame with a mechanical connector disposed within the channel.

2. The cooler merchandiser of claim 1, wherein the housing includes styrene material.

3. The cooler merchandiser of claim 1, wherein the housing and the frame are a unitary construction.

4. The cooler merchandiser of claim 1, wherein the frame extends along a first edge of the housing and along a second edge of the housing, the first edge positioned opposite the second edge.

5. The cooler merchandiser of claim 1, wherein the frame comprises a first element selectively attachable to a second element.

6. The cooler merchandiser of claim 1, wherein the channel is U-shaped, a first end of the frame being attached to the housing and a second end of the frame being free from the housing and extending away from the housing.

7. The cooler merchandiser of claim 1, further comprising a protective layer that covers at least a portion of the first removable insert.

8. The cooler merchandiser of claim 1, wherein the first removable insert includes a cardboard material.

9. The cooler merchandiser of claim 1, wherein the first graphics is customized to correlate to a first advertisement.

10. The cooler merchandiser of claim 9, further comprising a second removable insert, the second removable insert having a second graphics, wherein the second graphics is different from the first graphics of the first removable insert and is customized to correlate to a second advertisement.

11. A cooler merchandiser, comprising:

a housing defining an interior space for housing at least one product, the housing having a top wall, a bottom wall, and a plurality of side walls, wherein at least one of the side walls includes an opening for providing access to the interior space of the housing and wherein the housing includes a plurality of shelves that are horizontally extendable through the opening;

a frame attached to an exterior surface of at least one of the top wall, the bottom wall, and the plurality of side walls; and at least one removable cardboard insert having a customized graphics, wherein the frame and a side wall of the cooler merchandiser together form a channel configured to allow the at least one removable cardboard insert to slidingly engage the channel and be positioned between the frame and the side wall, the at least one removable cardboard insert being positioned adjacent to at least one of the top wall, the bottom wall, and at least one of the plurality of side walls when the at least one removable cardboard insert is positioned within the frame, wherein the frame extends along a first edge of the housing and along a second edge of the housing, the first edge positioned opposite the second edge.

12. The cooler merchandiser of claim 11, wherein the frame and the housing are a unitary construction.

13. The cooler merchandiser of claim 11, wherein the frame comprises a first element selectively attachable to a second element.

14. The cooler merchandiser of claim 11, wherein the channel is U-shaped, a first end of the frame being attached to the housing and a second end of the frame being free from the housing and extending away from the housing.

15. The cooler merchandiser of claim 11, wherein the customized graphics is related to a first advertisement.

16. A method of providing graphics on a cooler merchandiser, comprising the steps of:

applying a first graphics to a first removable insert and a second graphics to a second removable insert;

sliding the first removable insert into a channel formed by a frame and a side wall of the cooler merchandiser to be positioned between the frame and the side wall;

sliding the first removable insert out of the channel; and sliding the second removable insert into the channel, wherein the cooler merchandiser comprises a housing having a display portion for displaying a product;

an opening providing access to the display portion; and a plurality of shelves that are horizontally extendable through the opening, and wherein the first removable insert is secured within the frame with a mechanical connector disposed within the channel.

17. The method of claim 16, wherein the first removable insert and the second removable insert include a cardboard material.

18. The method of claim 16, wherein the first graphics and the second graphics are customized.

19. The method of claim 16, wherein the first graphics is related to a first advertisement and the second graphics is related to a second advertisement that is different from the first advertisement.

20. The method of claim 16, wherein the opening is configured to provide access to the cooling products, the opening at least partially covered by a thermoprotective barrier.

21. The method of claim 16, wherein the housing includes a styrene material.

22. The method of claim 16, wherein the mechanical connector is rubber, an adhesive, or at least one protrusion positioned on an edge of the first removable insert, wherein the protrusion may be fitted within the channel to secure the first removable insert within the frame.

23. The method of claim 16, wherein the first removable insert extends across substantially all of at least one side wall of the housing when positioned within the channel.

24. The cooler merchandiser of claim 1, wherein the first removable insert is positioned adjacent to at least one side wall of the housing when the first removable insert is positioned within the frame.

25. The cooler merchandiser of claim 1, wherein the mechanical connector is rubber, an adhesive, or at least one protrusion positioned on an edge of the first removable insert, wherein the protrusion may be fitted within the channel to secure the first removable insert within the frame.

26. The cooler merchandiser of claim 1, wherein the first removable insert extends across substantially all of at least one side wall of the housing.

* * * * *